US011041316B1

(12) United States Patent
Sauerwein

(10) Patent No.: US 11,041,316 B1
(45) Date of Patent: Jun. 22, 2021

(54) WALL CLADDING SYSTEM

(71) Applicant: Metal Design Systems, Inc., Cedar Rapids, IA (US)

(72) Inventor: David A. Sauerwein, Belleville, IL (US)

(73) Assignee: Metal Design Systems, Inc., Cedar Rapids, IA (US)

( * ) Notice: Subject to any disclaimer, the term of this patent is extended or adjusted under 35 U.S.C. 154(b) by 0 days.

(21) Appl. No.: 16/415,003

(22) Filed: May 17, 2019

Related U.S. Application Data

(60) Continuation of application No. 15/994,565, filed on May 31, 2018, now Pat. No. 10,337,189, which is a division of application No. 15/223,081, filed on Jul. 29, 2016, now Pat. No. 10,011,996.

(51) Int. Cl.
*E04F 13/08* (2006.01)
*E04C 2/30* (2006.01)

(52) U.S. Cl.
CPC ..... *E04F 13/0864* (2013.01); *E04C 2/30* (2013.01); *E04F 13/0876* (2013.01)

(58) Field of Classification Search
CPC ..... E04F 13/0862; E04F 13/0864; E04F 13/0871; E04F 13/0876; E04C 2/30
See application file for complete search history.

(56) References Cited

U.S. PATENT DOCUMENTS 1,656,434 A * 1/1928 Gietz ..... E04D 1/26 52/526
1,860,899 A * 5/1932 Miller ..... E04D 1/26 52/521
3,377,761 A * 4/1968 Skelton, Jr. ..... E04D 1/265 52/530
4,308,702 A * 1/1982 Rajewski ..... E04C 2/30 428/122
4,424,655 A 1/1984 Trostle
5,339,608 A 8/1994 Hollis
5,392,579 A 2/1995 Champagne
5,475,963 A 12/1995 Chelednik
5,729,946 A * 3/1998 Beck ..... E04D 3/30 52/519
5,857,303 A * 1/1999 Beck ..... E04D 3/30 52/105
5,878,543 A * 3/1999 Mowery ..... E04F 13/0864 52/519

(Continued)

OTHER PUBLICATIONS

American Roof Repair, "How to Get a new Roof or Have Existing T Lock Shingles Removed", Screen print of web page at http://www.americanroofrepair.com/how-to-get-a-new-roof-or-have-an-existing-t-lock-shingles-removed/.

(Continued)

*Primary Examiner* — Andrew J Triggs
(74) *Attorney, Agent, or Firm* — Shuttleworth & Ingersoll, PLC; Jason R. Sytsma

(57) ABSTRACT

Disclosed is a section of wall cladding comprises of a panel comprising a front side and a back side, a front hem at a top of the panel formed from a portion of material turned toward the front side of the panel and downward, and a rear hem at a bottom of the panel formed from a portion of material turned toward the back side of the panel and upward. The section of wall cladding can be t-shaped or any other shape to depending on the desired aesthetics.

6 Claims, 12 Drawing Sheets

(56) References Cited

U.S. PATENT DOCUMENTS

| | | | | |
|---|---|---|---|---|
| 6,029,415 | A * | 2/2000 | Culpepper | E04F 13/0864 52/522 |
| 6,195,952 | B1 * | 3/2001 | Culpepper | E04F 13/0864 52/522 |
| 6,341,463 | B1 * | 1/2002 | Dickey | E04F 13/0864 52/521 |
| 6,955,019 | B2 * | 10/2005 | Donlin | E04F 13/0864 52/314 |
| 7,204,063 | B2 * | 4/2007 | Kandalgaonkar | E04D 1/26 52/551 |
| 7,779,594 | B2 * | 8/2010 | Mowery | E04F 13/0864 52/539 |
| 8,484,931 | B2 | 7/2013 | Gleeson et al. | |
| 8,863,461 | B2 * | 10/2014 | Wagner | E04F 13/185 52/545 |
| 9,068,353 | B1 | 6/2015 | Kovalchuk | |
| 9,399,870 | B2 * | 7/2016 | Leitch | E04D 1/12 |
| 9,399,871 | B2 * | 7/2016 | Leitch | E04F 13/0864 |
| 9,416,539 | B2 * | 8/2016 | Duque | E04F 13/0862 |
| 9,890,538 | B2 * | 2/2018 | Maurer | E04F 13/0846 |
| 10,011,996 | B1 * | 7/2018 | Sauerwein | E04F 13/0862 |
| 10,337,189 | B1 * | 7/2019 | Sauerwein | E04F 13/0864 |
| 2011/0000160 | A1 | 1/2011 | Sarayli | |
| 2015/0292214 | A1 * | 10/2015 | Maurer | E04F 13/0846 52/547 |
| 2016/0047128 | A1 * | 2/2016 | Yoder | E04F 13/0864 52/528 |

OTHER PUBLICATIONS

Copper Development Association, Inc., "Wall Cladding: Horizontal Flat Lock System", Screen print of web page at http://www.copper.org/applications/architecture/arch_dhb/arch-details/wall_cladding/hor_flatlock.html.

Metal Design Systems, Inc., Series 60, Flat Lock Product Data Sheet.

* cited by examiner

WALL CLADDING SYSTEM

This application is a continuation of U.S. patent application Ser. No. 15/994,565 filed May 31, 2018, which application is a divisional of U.S. patent application Ser. No. 15/223,081 filed Jul. 29, 2016 (U.S. Pat. No. 10,011,996 granted Jul. 3, 2018), the entirety of which are incorporated by reference herein.

BACKGROUND

This invention relates to building products and, more particularly, to clipless interlocking wall cladding.

There are various conventional methods of cladding exterior building walls with esthetically pleasing fascia. The use of metal composite material (MCM) panel systems for exterior building facades are known in the prior art. Such MCM panels are typically made from two sheets of metal material bonded to a thermoplastic core. The metal material, or skin, can be made of any type metal sheet or decorative plating of zinc, copper, steel, titanium, and the like. MCM panels are strong and lightweight and can be applied to new building facings or during remodeling of an existing structure. MCM panels can be fabricated to conform to very complex and intricate building wall designs. Individual wall panels are mounted on extruded aluminum frame members and attached to the underlying building substructure with fasteners in a grid-like pattern. This is a time-consuming process because various sized panels are required to complete an installation.

It would be economically advantageous if the cost of such panels and the installation time could be reduced and the use of extruded frame members could be eliminated.

SUMMARY

Disclosed is a section of wall cladding for decorating the facade of a building, and a system of cooperating sections of wall cladding for the same. The section of wall cladding comprises of a panel comprising a front side and a back side, a front hem at a top of the panel formed from a portion of material turned toward the front side of the panel and downward, and a rear hem at a bottom of the panel formed from a portion of material turned toward the back side of the panel and upward. The section of wall cladding can be t-shaped or any other shape to depending on the desired aesthetics.

More specifically, the section of wall cladding comprises of a first edge positioned between the front hem and the rear hem and extending across a portion of the panel, and a second edge positioned between the front hem and the rear hem and extending across a portion of the panel. The section of wall cladding can be dimensioned with the bottom of the panel having a dimension of "x" and the first edge and the second edge of the panel each have a dimension of "x/2".

A system for decorating a facade of a building is also disclosed. The system comprises of a starter strip of cladding for attaching near a bottom of the facade of a building having a front facing hem. A first row of at least two sections of wall cladding can be positioned adjacent with each other with each section of wall cladding comprising of a panel comprising a front side and a back side, a front hem at a top of the panel formed from a portion of material turned toward the front side of the panel and downward, and a rear hem at a bottom of the panel formed from a portion of material turned toward the back side of the panel and upward. A starter shingle of cladding can be positioned between a gap between adjacent two sections of wall cladding of the first row. A second row of at least two sections of wall cladding have a portion of each of the two sections of wall cladding of the first row fit within the rear hem of the section of wall cladding of the second row. The portion of each of the two sections of wall cladding of the first row can comprise of a first edge of one section of wall cladding and a second edge of the other section of wall cladding. After the first row of sections of wall cladding, the subsequent rows can extend side-by-side in an interlocking relationship up the building facade.

DETAILED DESCRIPTION

Figure 1:
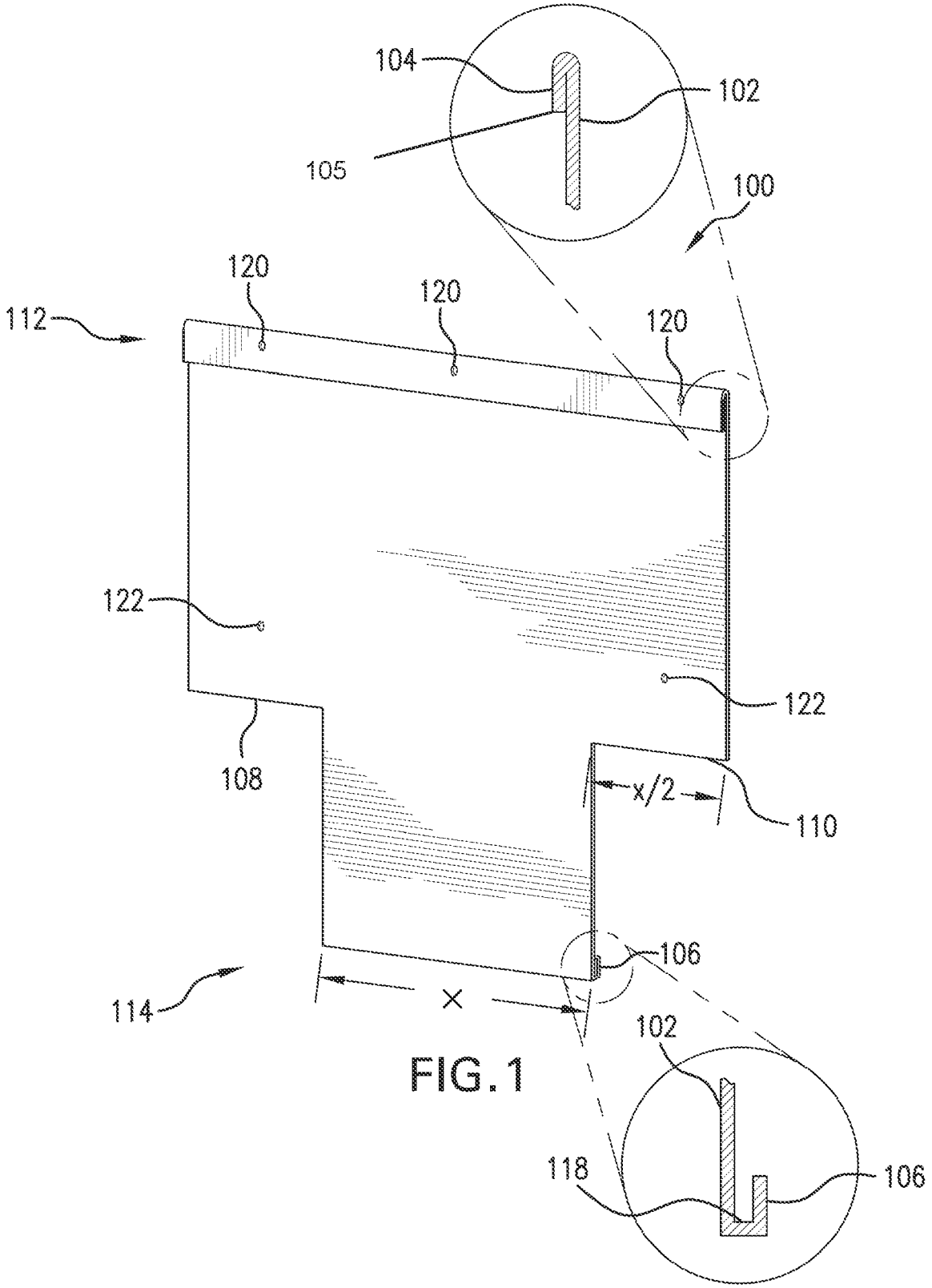
FIG. 1 is a perspective view of a section of wall cladding of the present disclosure.

Disclosed is a section of wall cladding 100 for applying to building facades. FIG. 1 shows section of wall cladding 100, which comprises of a panel 102 with a front hem 104 and a rear hem 106. This arrangement produces a system of clipless interlocking wall cladding that can be easily manufactured and installed while providing a pleasing esthetic appearance. The details of section of wall cladding 100 will be described more specifically below followed by a description of how multiple sections of wall cladding 100 cooperate to decorate the facade of a building.

Figure 2:
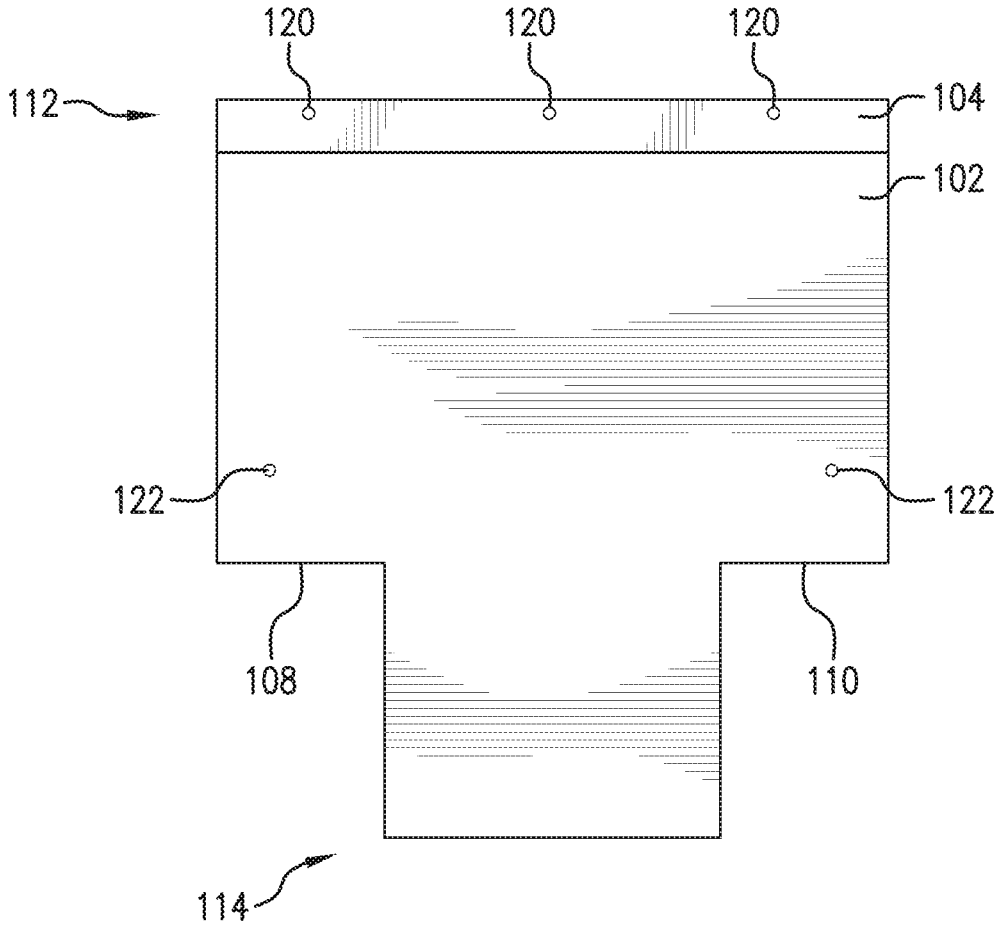
FIG. 2 is a front view of the section of wall cladding of FIG. 1.
Figure 3:
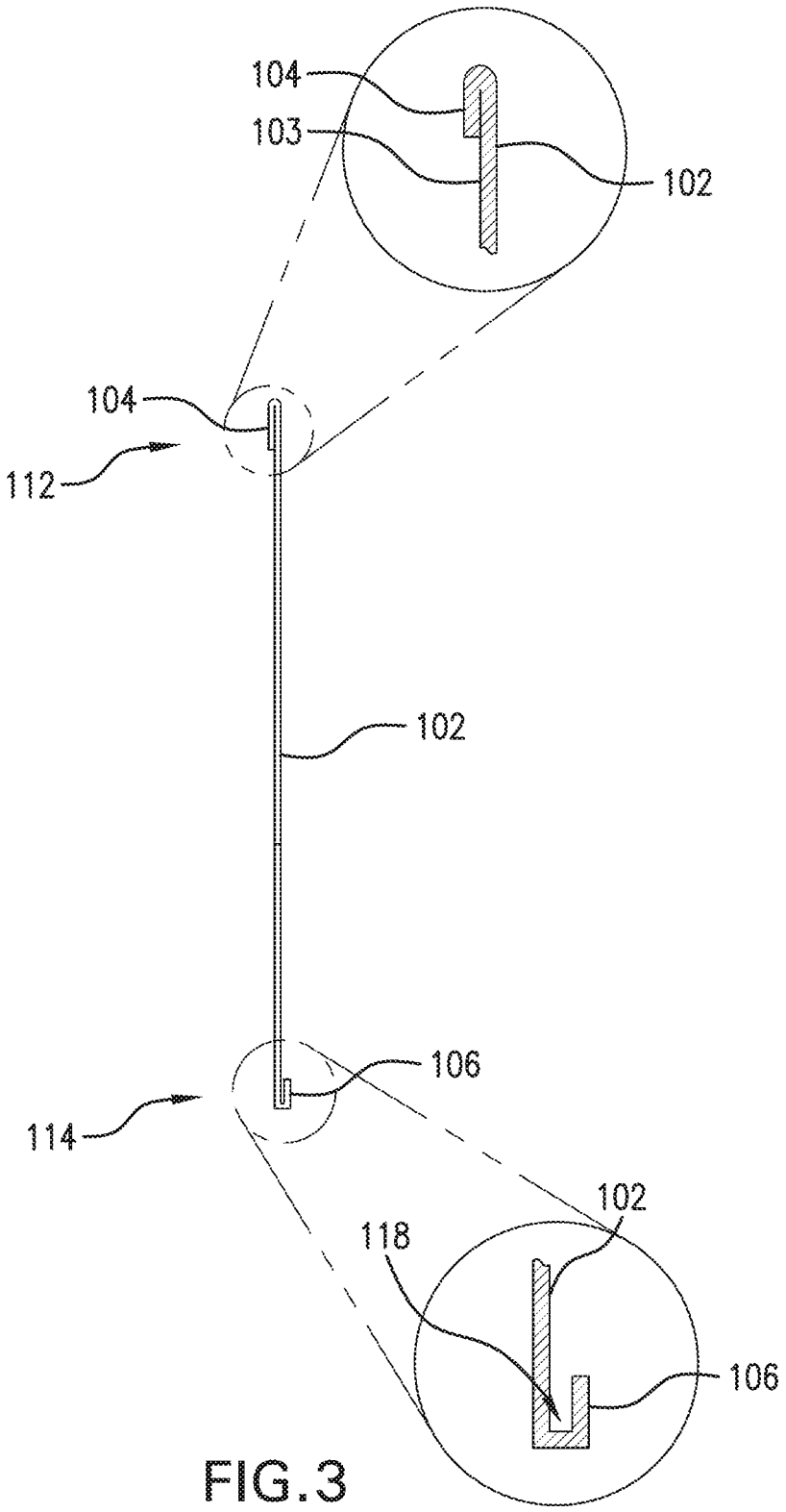
FIG. 3 is a side view of the section of wall cladding of FIG. 1.

As shown in FIGS. 1-3, panel 102 comprises of a metal composite material made from two sheets of metal material bonded to a thermoplastic core. Panel 102 is cut so that it is generally t-shaped with a first edge 108 and a second edge 110. Panel 102 has a top 112 and a bottom 114. Bottom 114 of panel 102 can be proportional in length to first edge 108 and second edge 110. If the length of bottom 114 is a dimension of "x", then the length of first edge 108 and second edge 110 is each "x/2". It is generally preferable that the length of first edge 108 and second edge 110 is less than or equal to "x/2". The reason for these dimensions will be apparent from the discussion of how multiple sections of wall cladding 100 cooperate together to form an aesthetically pleasing facade.

Section of wall cladding 100 comprises of front hem 104 and rear hem 106. Front hem 104 and edges 108 and 110 and rear hem 106 provide the clipless interlocking function of multiple sections of wall cladding 100 with each other. Front hem 104 is at a to 112 of panel 102 and formed from a portion of material turned toward the front side of panel 112 and downward and pressed onto the front side of panel 112 with a front face 105 perpendicular to the front side of panel 112. Front hem 104 provides a thickness of material to create a gap that allows the next section of wall cladding 100 to interlock. As shown in FIG. 4A and FIG. 4C, front hem 104 creates a first layer of material. Section of wall cladding 100*a* is attached overtop of front hem 104 of section of wall cladding 100*c*. A slot 109 remains in the area where front hem 104 of section of wall cladding 100*c* ends and edge 110 of section of wall cladding 100*a*. Rear hem 106 of section of wall cladding 100*e* interlocks with edge 110 of section of wall cladding 100*a* by sliding into this slot 109. More specifically, rear hem 106 of section of wall cladding 100*e* has an upward extending portion 111. This upward extending portion 111 fits between panel 102 of section of wall cladding 100*c* and panel 102 of section of wall cladding 100*a*. Front hem 104 is positioned at top 112 of panel 102 and formed from a portion of material turned toward the front side of panel 102 and downward. Rear hem 106 is positioned at bottom 114 of panel 102 formed from a portion of material turned toward the back side of panel 102 and upward. Rear hem 106 has a gap 118 (shown in FIG. 3) that is slightly more than the thickness of edge 108 or edge 110 of section of wall cladding 100 in which to receive the same to interlock two sections of wall cladding 100. More specifically, as shown in FIG. 4A, panel 102 of section of wall cladding 100*a* fits into gap 118 of rear hem 106 of section of wall cladding 100*e*.

Section of wall cladding 100 is mounted to the building facade by fasteners through one or more holes 120 through front hem 104. At least two holes 120 are preferred, and three holes 120 are shown in the illustrated embodiment to firmly attach section of wall cladding 100 to a building. Another set of holes 122 can be positioned one hole 122 above each of first edge 108 and second edge 110. This set of holes 122 secure bottom edge 114 when rear hem 106 engages over edges 108 and 110 of wall cladding 100.

Figure 4:
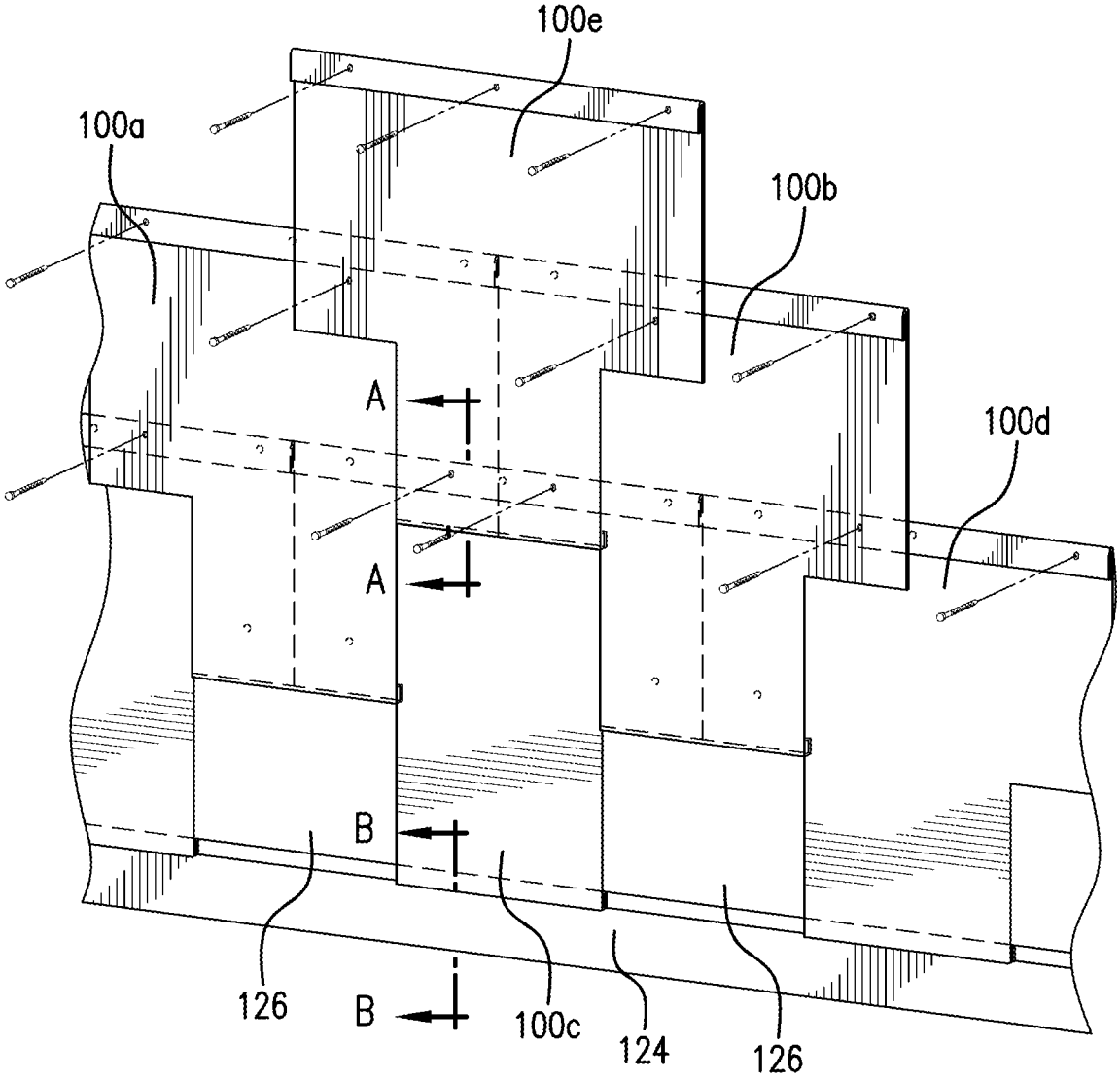
FIG. 4 is an overlapping array of sections of wall cladding of FIG. 1.
Figure 4A:
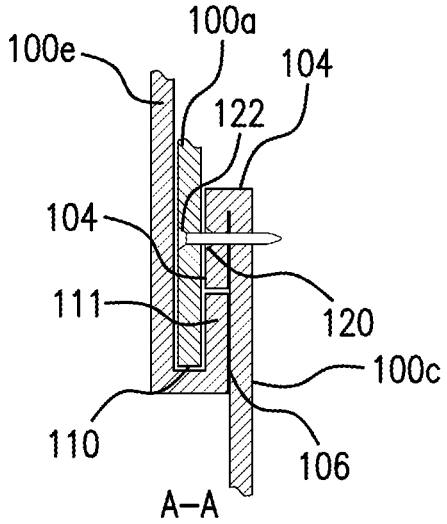
FIG. 4A is a cross-sectional view taken along the line A-A of FIG. 4.
Figure 4B:
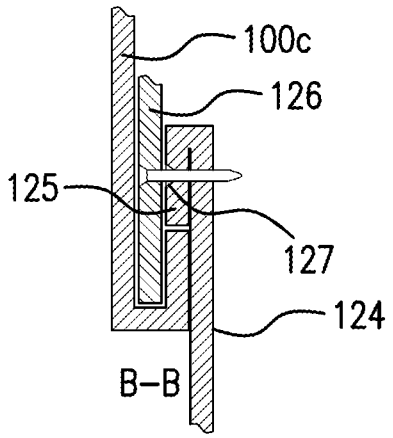
FIG. 4B is a cross-sectional view taken along the line B-B of FIG. 4.
Figure 4C:
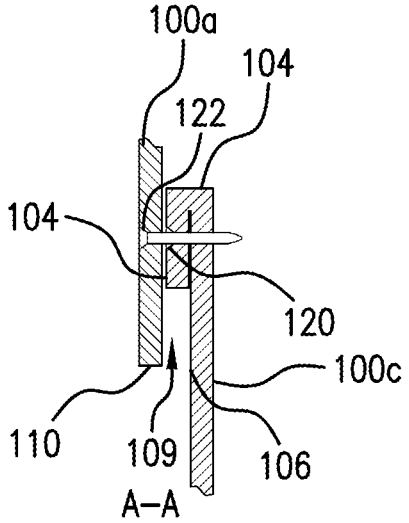
FIG. 4C is the cross-sectional view of FIG. 4A with section of wall cladding 100*e* removed to show the slot.
Figure 5:
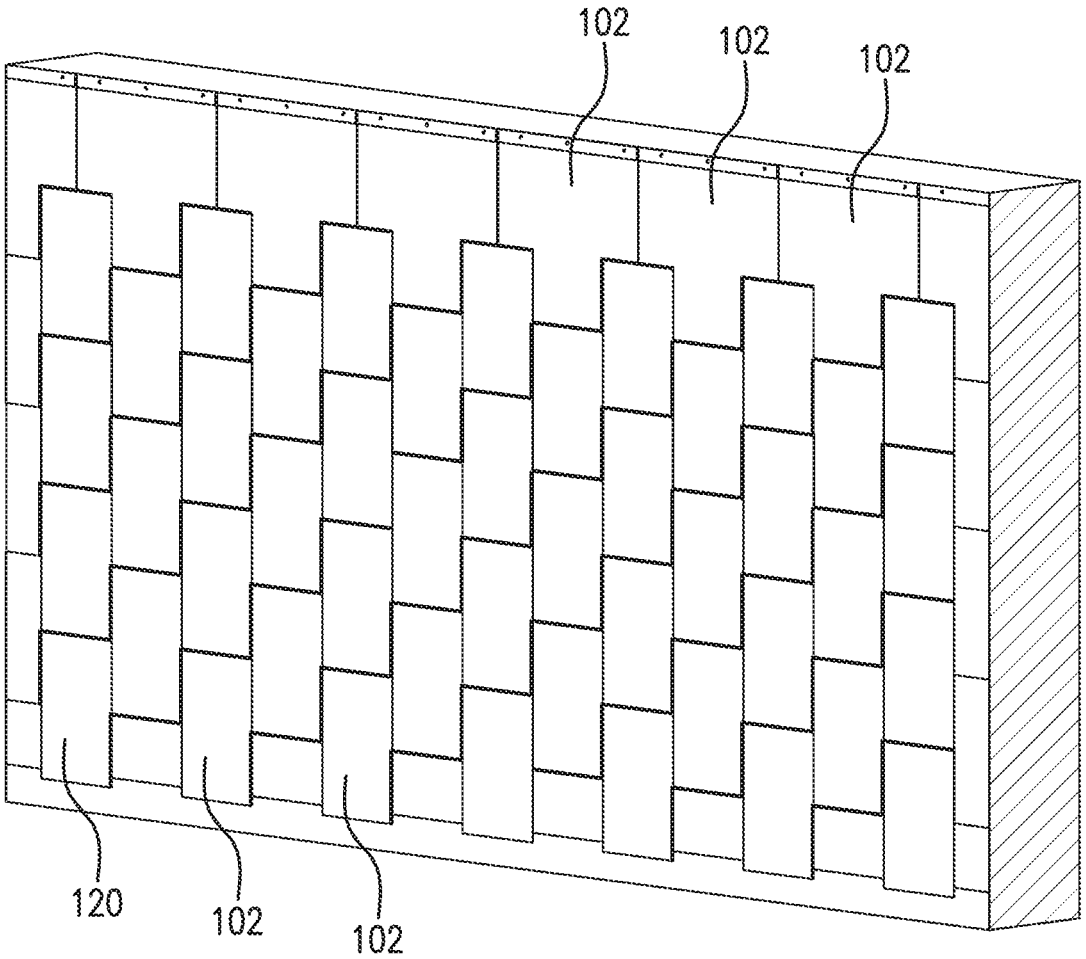
FIG. 5 is a perspective view of a section of building with the wall cladding system of this disclosure.
Figure 6:
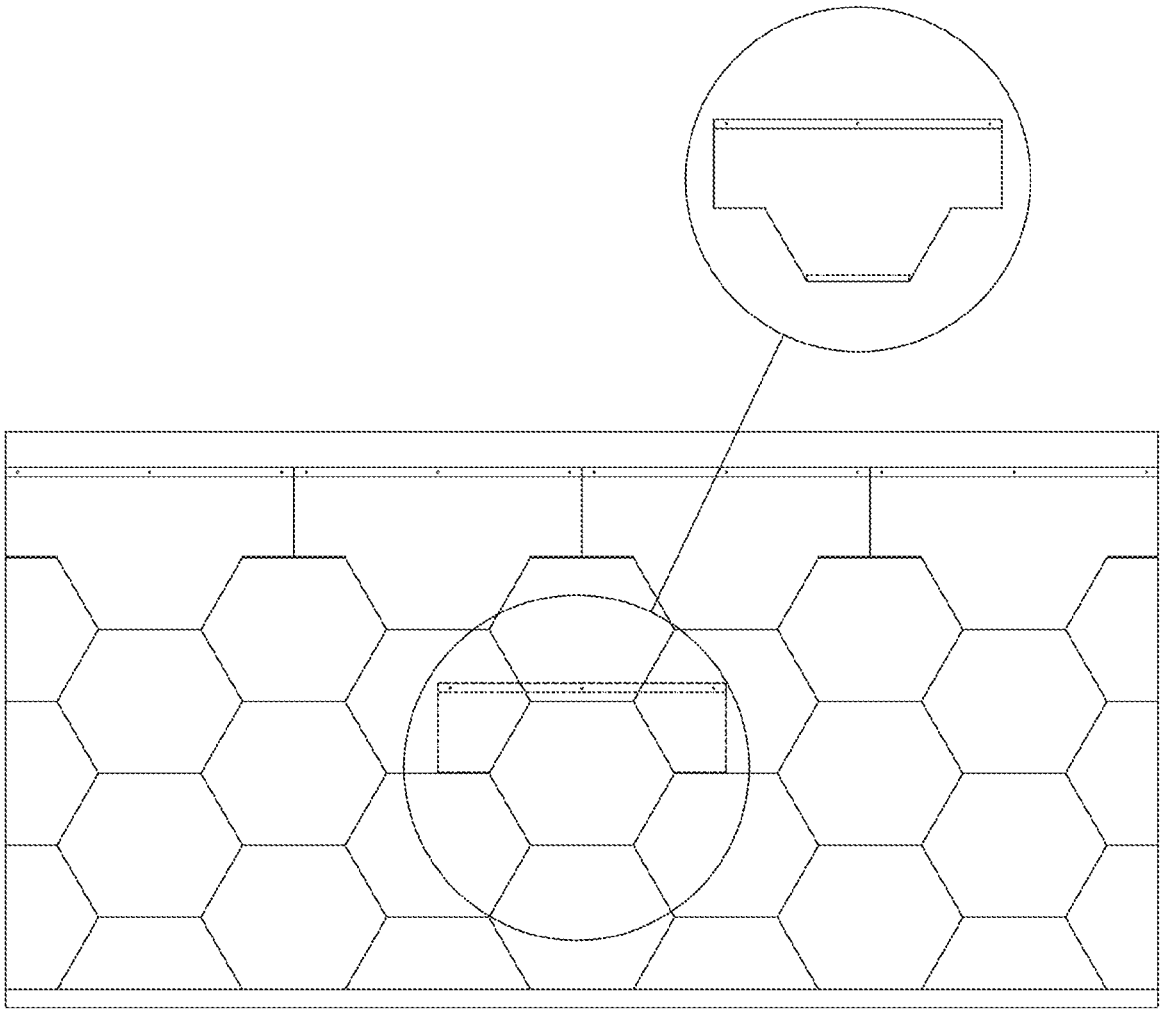
FIG. 6 is a perspective view of a section of building with the wall cladding of a different design according to this disclosure.
Figure 7:
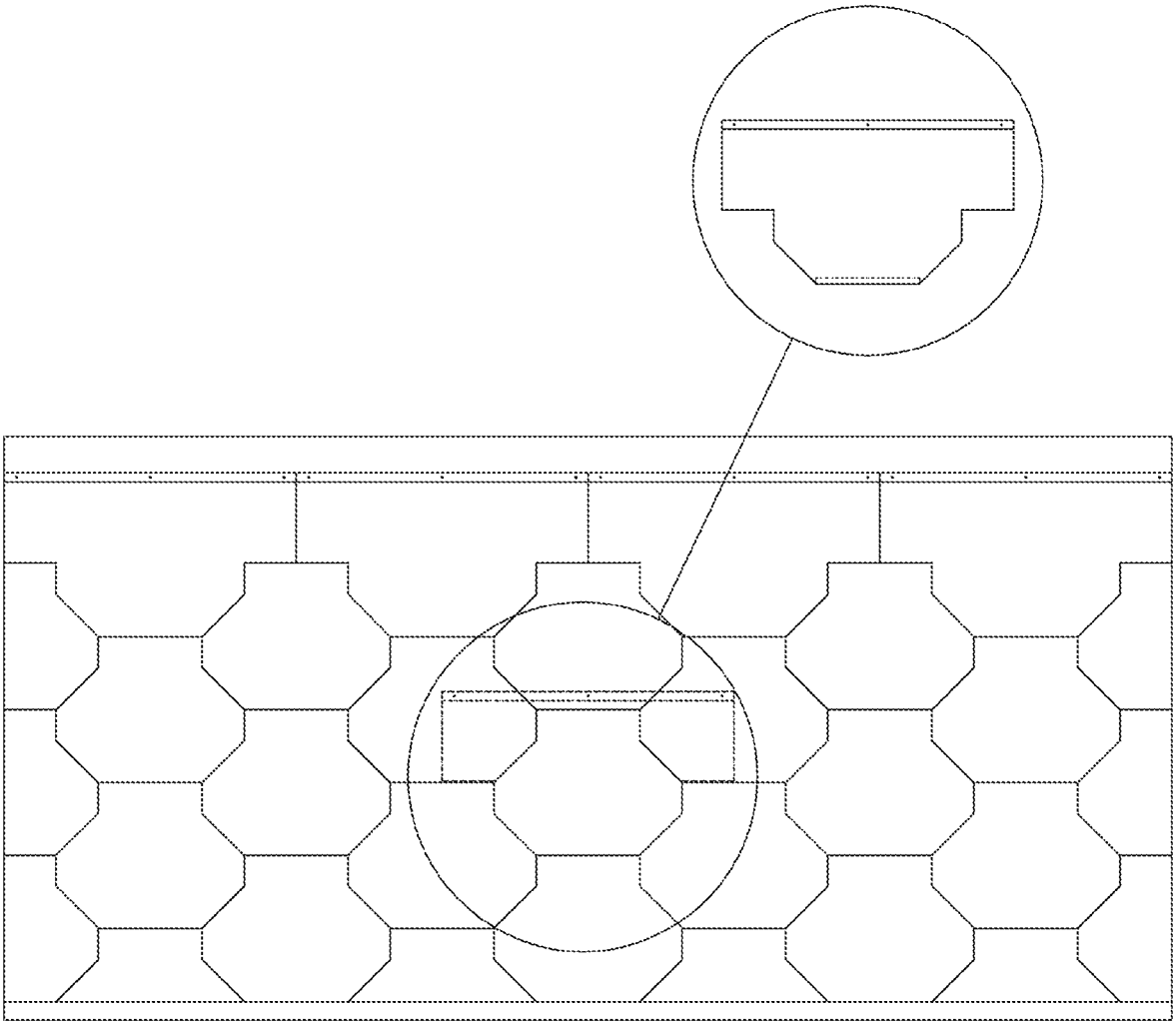
FIG. 7 is a perspective view of a section of building with the wall cladding of a different design according to this disclosure.
Figure 8:
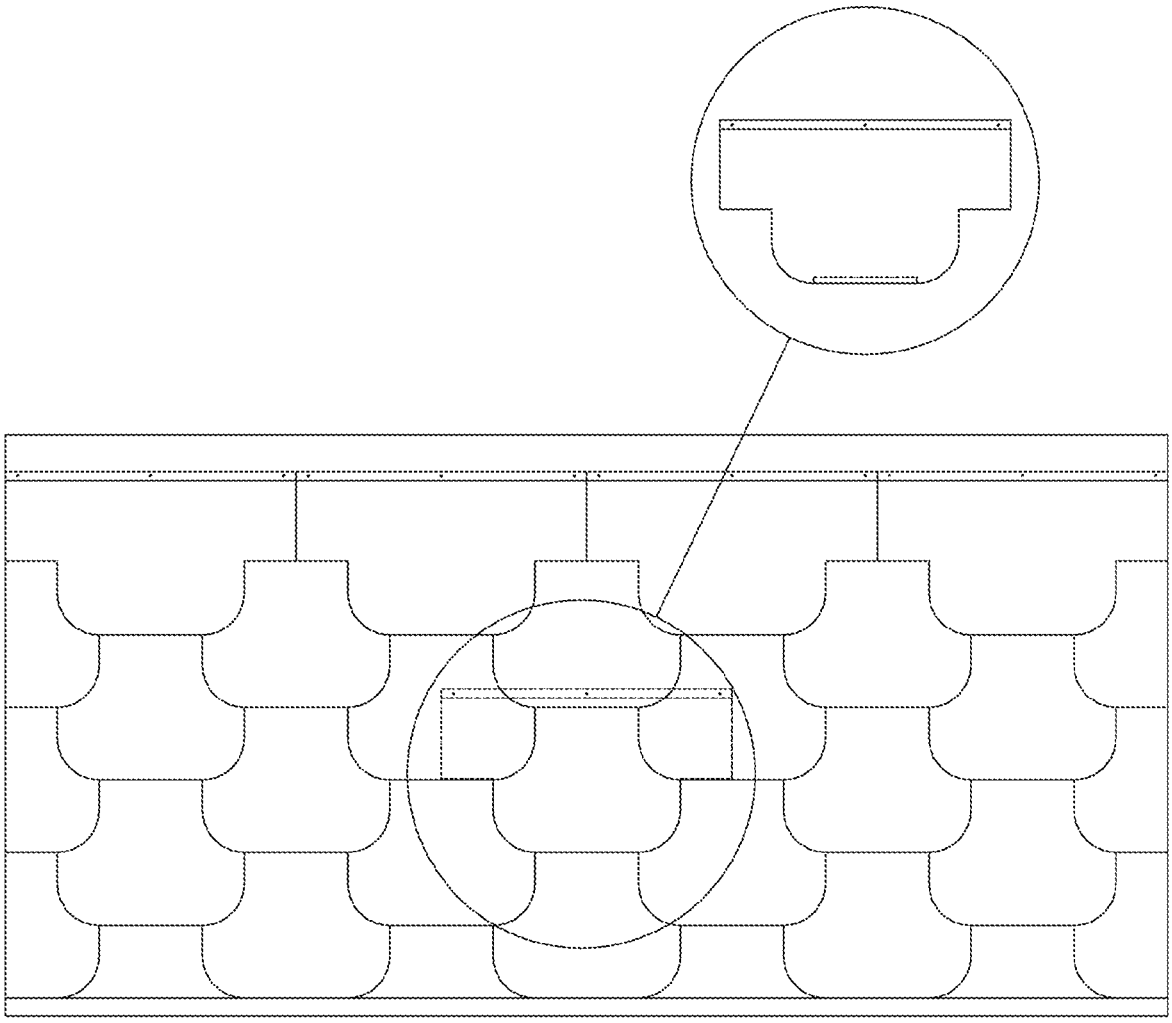
FIG. 8 is a perspective view of a section of building with the wall cladding of a different design according to this disclosure.
Figure 9:
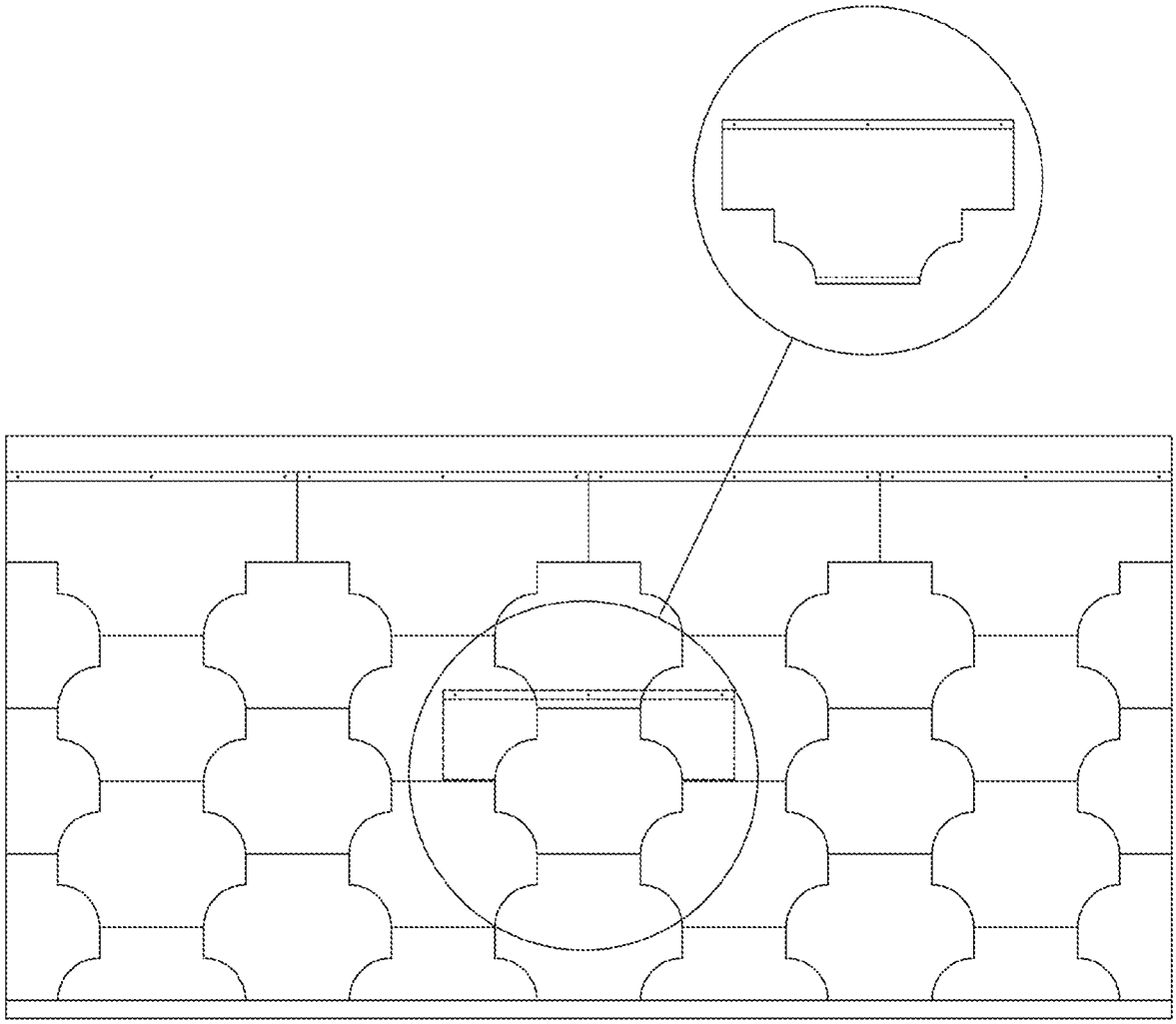
FIG. 9 is a perspective view of a section of building with the wall cladding of a different design according to this disclosure.

FIGS. 4 and 5 show multiple sections of wall cladding 100 secured in an interlocking relationship to the building facade. Sections of wall cladding 100 can be attached in a horizontal row across a side of the building. A starter strip of cladding 124 can be attached near the base of the building. Starter strip of cladding 124 has a front facing hem 125 and a hole 127 for receiving a fastener for attaching starter strip of cladding 124 to the building. Sections of wall cladding 100*c* and 100*d* show the beginning of a row. Sections of wall cladding 100*c* and 100*d* are each secured to the building with fasteners through holes 120 through front hem 104 and fasteners through the other set of holes 122 in panel 102. In between sections of wall cladding 100, which form the bottom row, above starter strip of cladding 124 and below sections of wall cladding 100*c* and 100*d*, starter shingle of cladding 126 can be attached to fill in the gaps between adjacent sections of wall cladding 100. Starter shingle of cladding 126 can be a rectangular shaped flat panel, and is installed prior to installation of sections of wall cladding 100, and extends in the longitudinal direction lengthwise with starter strip of cladding 124.

Thereafter, a section of wall cladding 100*b* is interlocked with sections of wall cladding 100*c* and 100*d* with rear hem 106 receiving first edge 108 of section of wall cladding 100*d* and second edge 110 of section of wall cladding 100*c*. The corresponding hole 122 and its fastener above each of first edge 108 and second edge 110 are covered by a portion of panel 102. An exposed portion of front hem 104 on sections of wall cladding 100*c, d* are also covered by a portion of panel 102. Section of wall cladding 100*b* can be secured to the building with fasteners through holes 120 in front hem 104. Section of wall cladding 100*a* is attached in a similar manner next to section of wall cladding 100*b*. This interlocking attachment of multiple sections of wall cladding 100 continues until the side is covered as shown in FIG. 5.

In this regard, with respect to FIG. 4A, a system for decorating a facade of a building is disclosed. The system comprises of a plurality of interlocking sections of wall cladding comprising section of wall cladding 100*c* comprising of panel 102 and a section of material, such as front hem 104, which cooperates with a thickness of panel 102 to create a step 103. A second section of wall cladding 100*a* comprises of a portion of material (near edge 110) overlaying first section of wall cladding 100*c* to form a space. A third portion of wall cladding 100*e* comprises of a rear hem 106 for hooking into the space to interlock section of wall cladding 100*c*, section of wall cladding 100*a*, and section of wall cladding 100*e*. Section of wall cladding 100*c* and second section of wall cladding 100*a* are fastened to the building with fastener 120 through the portion of material from second section of wall cladding 100*a* and front hem 104 of section of wall cladding 100*c*. Front hem 104 of first section of wall cladding 100*c* is pressed on to panel 102 to form a continuous section of material.

Sections of wall cladding 100 can be formed of a variety of shapes to provide a decorative appearance to a building facade. FIGS. 6-9 show alternative shapes of sections of wall cladding 100. These shapes function the same as section of wall cladding 100 with the double hem for clipless interlocking with each other.

Figure 10:
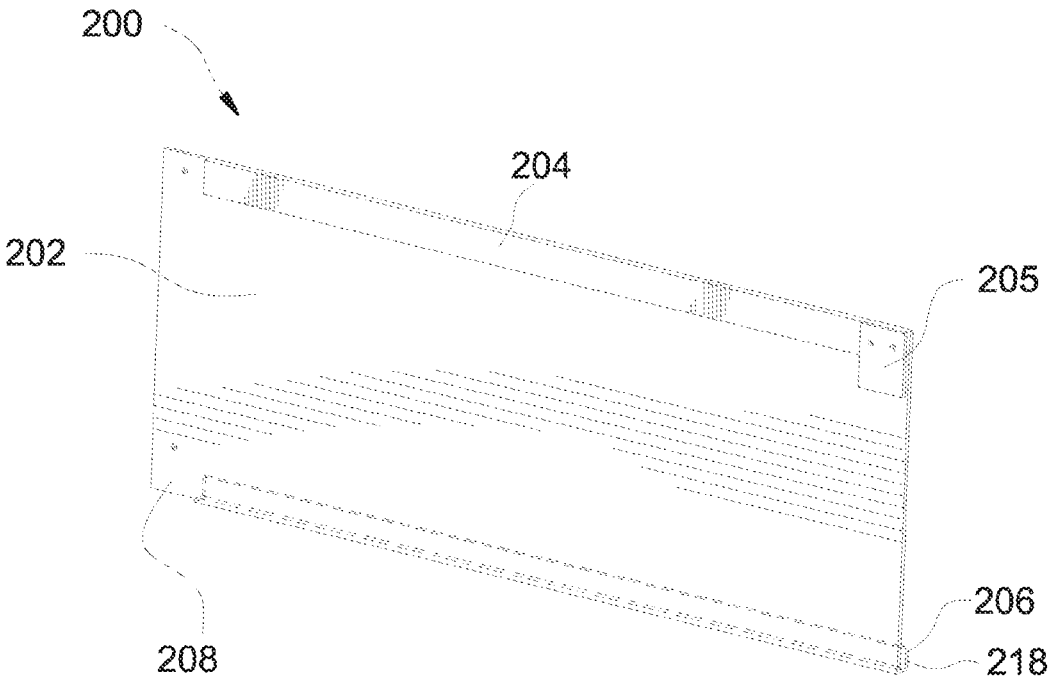
FIG. 10 is a perspective view of a section of wall cladding of the present disclosure.

FIG. 10 shows a section of wall cladding 200 with a rectangular shape to provide a rectangular appearance. Panel 202, again comprises of a metal composite material made from two sheets of metal material bonded to a thermoplastic core. Panel 202 is cut so that it is generally rectilinear with a bottom edge 208 and a top edge 210. Section of wall cladding 200 also comprises of front hem 204 and rear hem 206. Front hem 204 and edges 208 and 210 and rear hem 206 provide the clipless interlocking function of multiple sections of wall cladding 200 with each other. Front hem 204 provides a thickness of material to create a gap that allows the next section of wall cladding 200 to interlock.

Figure 11:
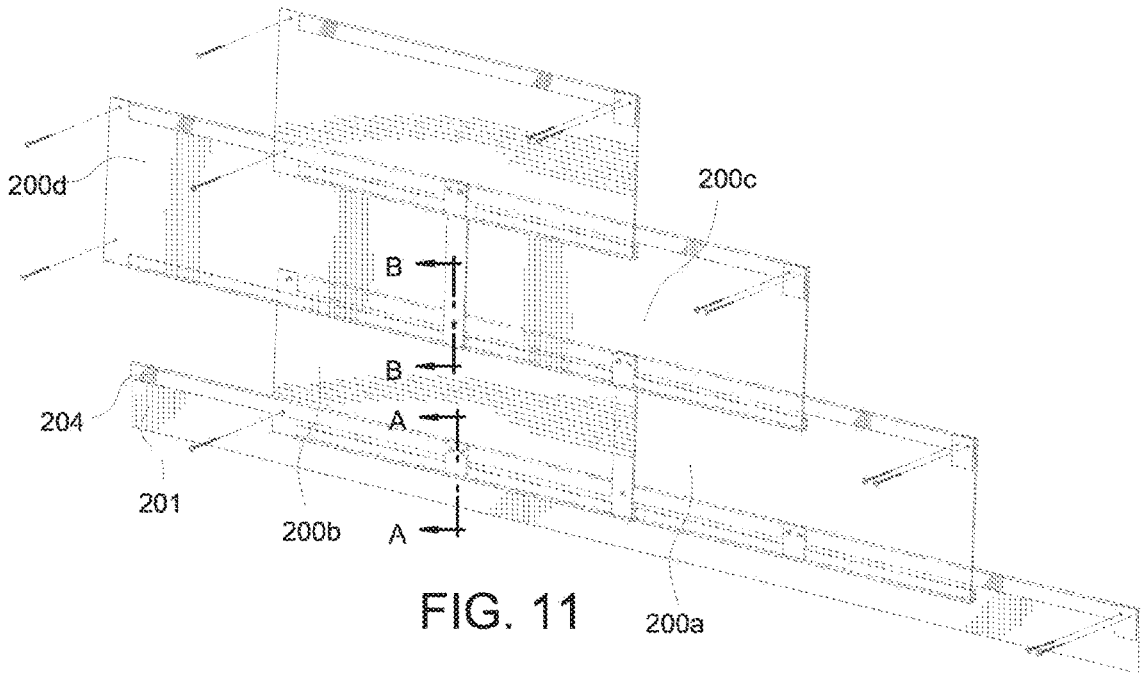
FIG. 11 is an overlapping array of sections of wall cladding of FIG. 10.
Figure 11A:
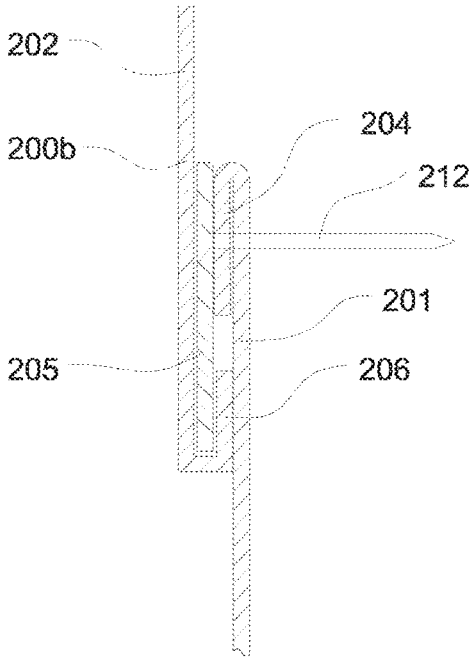
FIG. 11A is a cross-sectional view taken along the line A-A of FIG. 11.

As shown in FIG. 11A front hem 204 creates a first layer of material. Section of wall cladding 200*b* is attached overtop of front hem 204 and a spacer 205 of a section of wall cladding 201. Spacer 205 serves the same function as edge 208 and edges 108 and 110 of section of wall cladding 100. Spacer 205 provides an interlock with gap 218 near the middle of the bottom edge of section of wall cladding 200.

A gap remains in the area where front hem 204 of starter strip of wall cladding 201 ends. Rear hem 206 of section of wall cladding 200*b* interlocks with edge 208 of section of wall cladding 200*a* by sliding into this gap. Front hem 204 is positioned at the top of panel 202 and formed from a portion of material turned toward the front side of panel 202 and downward. Rear hem 206 is positioned at the bottom of panel 202 formed from a portion of material turned toward the back side of panel 202 and upward. Rear hem 206 has a gap 218 (shown in FIG. 10) that is slightly more than the thickness of edge 208 of section of wall cladding 200 in which to receive the same to interlock two sections of wall cladding 200.

More specifically, FIG. 11 shows multiple sections of wall cladding 200 secured in an interlocking relationship to the building facade. Sections of wall cladding 200 can be attached in a horizontal row across a side of the building. A starter strip of cladding 201 can be attached near the base of the building. Starter strip of cladding 201 has a front facing hem 204. Sections of wall cladding 200*a* and 200*b* start the beginning of a first row, and are each secured to the building with fasteners 212 through front hem 204. Section of wall cladding 200*a* interlocks with tap 205 on starter strip of cladding 201, and is secured to the wall with fastener 212. Section of wall cladding 200*b* is installed in the same manner and bottom right corner of panel 202 of section of wall cladding 200*b* cooperates with edge 208 of section of wall cladding 200*a*.

Thereafter, for the second row, a section of wall cladding 200*c* is interlocked with sections of wall cladding 200*a* and 200*b* with edge 208 of section of wall cladding 200*c* receiving rear hem 206 of section of wall cladding 200*d* and spacer 205 of section of wall cladding 200*d*.

Figure 11B:
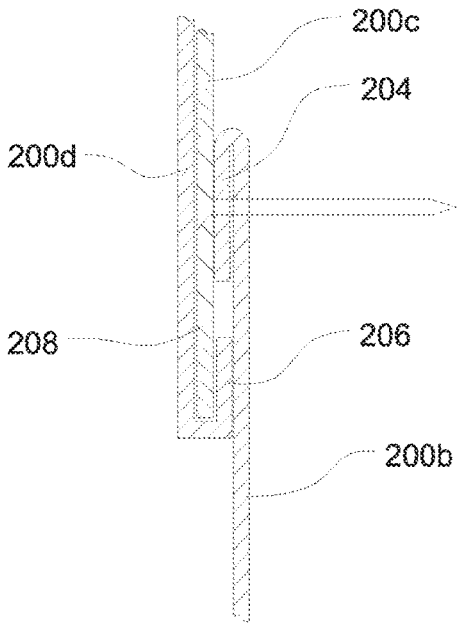
FIG. 11B is a cross-sectional view taken along the line B-B of FIG. 11.

In this regard, with respect to FIG. 11B, a system for decorating a facade of a building is disclosed. The system comprises of a plurality of interlocking sections of wall cladding 200 comprising section of wall cladding 200*b* comprising of panel 202 and a section of material, such as front hem 204, which cooperates with a thickness of panel 202 to create a step. Section of wall cladding 200*c* comprises of a portion of material overlaying section of wall cladding 200*b* to form a space. Section of wall cladding 200*d* comprises of a rear hem 206 for hooking into the space to interlock section of wall cladding 200*b*, section of wall cladding 200*c*, and section of wall cladding 200*d*. Section of wall cladding 200*c* and section of wall cladding 200*b* are fastened to the building with fastener 212 through the portion of material from section of wall cladding 200*c* and front hem 204 of section of wall cladding 200*b*. Front hem 204 of section of wall cladding 200*b* is pressed on to panel 202 to form a continuous section of material.

The exposed portion of front hem 204 on sections of wall cladding 200*a, b* are also covered by sections of wall cladding 200*c*. Section of wall cladding 200*d* is attached in a similar manner next to section of wall cladding 200*c*. This interlocking attachment of multiple sections of wall cladding 100 continues until the side is covered.

What is noticeably distinct about the wall cladding system herein described is the aesthetically pleasing rectangular grid pattern created by multiple interlocking sections of wall cladding 100, 200. In addition to the aesthetics of the wall cladding system, each section of wall cladding 100, 200 has a thin profile as thick as the double hemmed edges (front hem 104, 204 and rear hem 106, 206). All sections of wall cladding 100, 200 are the same size, which means the wall cladding system is less expensive to manufacture and easier to install. There are no custom-made parts required. No extruded frame members are needed between the panels and the building fascia. Furthermore, because of the interlocking nature of sections of wall cladding 100 where each section of wall cladding 100, 200 covers its neighboring section of wall cladding 100, 200 the tolerances are not as critical, which decreases the manufacturing time and cost. Furthermore, wall cladding 100, 200 has superior structural performance due to the interlocking nature of front hem 104, 204 and rear hem 106, 206 with other sections of wall cladding 100, 200.

Although not specifically illustrated in the drawings, it should be understood that additional equipment and structural components will be provided as necessary and that all of the components described above are arranged and supported in an appropriate fashion to form a complete and operative cladding system incorporating features of the present invention.

Moreover, although illustrative embodiments of the invention have been described, latitude of modification, change, and substitution is intended in the foregoing disclosure, and in certain instances some features of the invention will be employed without a corresponding use of other features. Accordingly, it is appropriate that the appended claims be construed broadly and in a manner consistent with the scope of invention.

What is claimed is:

1. A section of wall cladding configured for attachment to a wall, the section of wall cladding comprising:

a panel comprising a front side configured for facing away from the wall and a back side configured for facing toward the wall;

a front hem at a top of the panel formed from a portion of material turned toward the front side of the panel and downward and pressed onto the front side of the panel with a front face perpendicular to the front side of the panel, wherein the front side of the panel is flat from a bottom of the front side of the panel to the front face of the front hem; and a rear hem at the bottom of the panel formed from a portion of material turned toward the back side of the panel and upward and with a gap measuring a thickness of the panel to receive another panel of a same thickness between the portion of material and the back side of the panel.

2. The section of wall cladding of claim 1, and further comprising a first edge positioned between the front hem and the rear hem and extending across a portion of the panel and a second edge positioned between the front hem and the rear hem and extending across a portion of the panel.

3. The section of wall cladding of claim 1, and further comprising at least two holes for receiving fasteners extending through the front hem.

4. The section of wall cladding of claim 1, wherein the front hem is formed from a portion of material folded onto itself with substantially no space there between to form a thickness of material useable to create a slot to receive an interlocking section of wall cladding.

5. The section of wall cladding of claim 1, wherein the front hem and the rear hem are on opposite sides of the section of wall cladding, wherein the front hem and the rear hem are oriented parallel with each other.

6. A section of wall cladding configured for attachment to a wall, the section of wall cladding comprising:

a panel comprising a front side configured for facing away from the wall and a back side configured for facing toward the wall;

a front hem at a top of the panel formed from a portion of material turned toward the front side of the panel and downward and pressed onto the front side of the panel;

a rear hem at a bottom of the panel formed from a portion of material turned toward the back side of the panel and upward and with a gap slightly more than a thickness of the panel between the portion of material and the back side of the panel;

a first edge positioned between the front hem and the rear hem and extending across a portion of the panel;

a second edge positioned between the front hem and the rear hem and extending across a portion of the panel, wherein the bottom of the panel has a dimension of "x" and the first edge and the second edge each have a dimension of less than or equal to "x/2".

* * * * *